United States Patent [19]

Nylund

[11] 3,974,538

[45] Aug. 17, 1976

[54] TURQUOISE SCRUBBER

[76] Inventor: Kenneth G. Nylund, Rte. 1, Box 40C, Globe, Ariz. 85501

[22] Filed: Sept. 2, 1975

[21] Appl. No.: 609,389

[52] U.S. Cl. ..... 15/21 D; 15/3.16
[51] Int. Cl.[2] ..... A46B 13/02
[58] Field of Search ..... 15/3–3.16, 15/21 D, 21 A, 90

[56] References Cited

UNITED STATES PATENTS

| | | | |
|---|---|---|---|
| 2,212,560 | 9/1940 | Foley | 15/3 |
| 3,189,927 | 6/1965 | Dyar | 15/3.16 |

*Primary Examiner*—Edward L. Roberts
*Attorney, Agent, or Firm*—John A. Robertson

[57] ABSTRACT

A turquoise scrubber comprising a base and a casing upstanding from the base and having closed and open ends. A motor driven shaft extends through the casing centrally thereof and is journalled in supports upstanding from the base. A cylindrical screen is driveably mounted on the shaft and is spaced from the casing. A motor driven brush is swingably mounted on the base and extends into the screen. A discharge scoop is carried by a frame that is pivoted on the shaft and is located within the screen where it is adapted to be either spaced from the screen or have its leading edge in engagement therewith. Mechanism is provided to impart a limited arcuate movement to the scoop in reverse directions. A loading chute is positioned at the open face of the casing and includes a tube which extends into the screen. An exhaust conduit communicates with the closed end of the casing to withdraw fumes therefrom.

10 Claims, 8 Drawing Figures

101
99
96
FORWARD-BACK
100
86

86
83
84
TORQUE
FAN
ON/OFF
102
SPEED
FORWARD
REVERSE
91
POWER
ON
90
OFF
BRUSH
ON/OFF
82
97
96
95
94
85

99
95
94
UP-DOWN
98
85

TURQUOISE SCRUBBER

The present invention has to do with a machine for scrubbing turquoise to remove a gel which collects thereon as an incident to chemical treatment of the turquoise for conditioning purposes and is concerned primarily with such a scrubber which may be operated with a high degree of safety to personnel and also with a high degree of efficiency.

BACKGROUND OF THE INVENTION

At the present time the public demand for turquoise is becoming more and more widespread. Turquoise is mined from earth formations, often as an incident to the mining of copper. After the turquoise is mined it must be conditioned for use by the manufacturers of jewelry. This conditioning is accomplished by placing the turquoise rocks in a container to which a polyester resin is added. It is left in the containers, wherein it is immersed in the polyester resin, for a period ranging from two to three weeks. During this time the polyester resin penetrates the rocks to achieve the desired conditioning thereof. At the same time, gelatinous formations are built up on the rock surfaces. This so called gel must be removed to place the turquoise in a marketable condition. At the present time this removal is accomplished largely by manual scrubbing operations. It is accompanied by the exudation of fumes from the gel which, to say the least, are highly uncomfortable and disagreeable if not perilous to the health of the scrubbing personnel.

So far as the present applicant is aware there is now no known apparatus or machine designed specifically for the scrubbing of turquoise. Nor is there available any scrubbing machine designed for use on materials other than turquoise which will accomodate the conditions attending the removal of gel from turquoise rocks.

There are examples in the known art of machines for scrubbing rock or gravel. There are also examples of cleaning apparatus which include cylindrical screens which rotate on a horizontal axis, however, none of these known devices are adapted to operate efficiently under conditions which attend the scrubbing of turquoise.

OBJECTS OF THE INVENTION

With the foregoing conditions in mind the present invention has in view the following objectives:

1. To provide a turquoise scrubber which includes means for exhausting fumes which emanate from the gel on the turquoise away from operating personnel.

2. To provide, a turquoise scrubber of the type noted, which includes as a characteristic and essential element a cylindrical screen which rotates on a horizontal axis and which is housed within a casing having a closed end and an open end.

3. To provide, in a turquoise scrubber of the character aforesaid, mechanism for rotating said screen at high speed to cause the gel to be removed from the rocks by centrifugal force.

4. To provide, in a turquoise scrubber of the kind described, a motor driven brush which rotates on an axis parallel to the axis of the screen, and which extends into the screen and is swingably mounted so that it may be moved into and out of engagement with rocks in the screen and/or the screen.

5. To provide, in a turquoise scrubber of the type noted, which includes a shaft on which the screen is driveably mounted, a discharge scoop which is carried by a frame that is pivoted on the shaft. The scoop extends into the screen and has a leading edge and a discharge spout. Mechanism is provided to impart limited amount of arcuate movement to the scoop in reverse directions.

6. To provide, in a turquoise scrubber of the character aforesaid, mechanism on the frame for moving the discharge scoop either into a position in which it is spaced from the screen or one in which its leading edge engages the screen.

7. To provide, in a turquoise scrubber of the kind described, a loading chute which is positioned at the open face of the casing and has a tube connected therewith which extends into the screen.

8. To provide, in a turquoise scrubber of the type noted, a control console including operating members for the mechanism which imparts the movements to the discharge scoop.

Various other more detailed objects and advantages of the invention, such as arise in connection with carrying out the above ideas in a practical embodiment will in part become apparent and in part be hereinafter stated as the description of the invention proceeds.

SUMMARY OF THE INVENTION

The foregoing objectives are achieved by providing a turquoise scrubber comprising a base which is generally rectangular and from which upstand, at points adjacent to its opposite ends, a pair of shaft supports. A casing is mounted on this base adjacent to one of these supports and is preferably of two parts. Thus it consists of a lower rectangular part having side walls and an upper semi-cylindrical part which is hingedly connected at one end to the lower part. This casing has a closed end and an open face with the cylindrical wall of the upper part blending in with the side walls of the lower part.

A shaft extends through the casing substantially central thereof and is journalled in the shaft supports. This shaft is driven by an electric motor mounted on the base exteriorally of the casing. A cylindrical screen is driveably mounted on this shaft and is positioned within the casing in spaced relation to the semi-cylindrical and side wall surfaces thereof.

A brush carrying frame is pivotally mounted on the base just in front of the open face of the casing. A motor on this frame drives a rotating brush which extends into the interior of the screen. A handle on this frame provides for manually swinging the brush into and out of engagement with rock and/or the screen.

A loading chute is mounted on the upper casing part and carries a tube which extends into the screen with its open end being spaced from the screen.

A second or discharge scoop carrying frame is pivotally mounted on the shaft and is imparted a limited amount of swinging movement in reverse directions by a pneumatic cylinder and piston assembly. A discharge scoop is carried by the frame and is located within the screen in the lower region thereof. A second pneumatic cylinder and piston assembly on the frame is operable to move the discharge scoop from a position in which it is spaced from the screen to one in which its leading edge engages the screen. The discharge scoop includes a spout which extends through the open face of the casing and through which scrubbed rock is deposited into a removable receptacle on the base. A brake is provided on one end of the shaft and is hand operated when it is desired to slow down the rotation of the screen.

In operation the discharge scoop is first moved into the position in which it is spaced from the screen and at one end of its arcuate stroke of movement. A batch of turquoise rocks is deposited into the loading chute and thence passes onto the inner surface of the screen. The speed of rotation of the screen is now increased to the order of about 800 rpm, thus gel is removed from the rock by centrifugal force and passes through the screen and falls downwardly into the lower casing part. With the brush not rotating under power the operator grasps the handle and as occasion demands forces the brush into engagement with the rock and/or the screen. This results in a scrubbing action which enters into the gel removing operation. Any gel which may collect on the brush bristles is removed therefrom by centrifugal force generated by rotating the brush under power.

After the rock has been scrubbed to the required degree, which ordinarily will take place in about two minutes, the screen is slowed down and the scoop lowered into a position in which its leading edge engages the screen. The frame carrying the scoop is then swung under the influence of the pneumatic cylinder and piston to swing the scoop into a position in which its leading edge is at the opposite end of its arcuate stroke in which it is upraised and the spout is in its lowermost position. During this movement of the scoop, rock is picked up thereby and passed through the spout into a receptacle on the base. When one receptacle is filled it is replaced by another one.

The lower casing part is provided with a sliding drawer which receives the gel which has been removed from the rock. This drawer may be removed from time to time for emptying purposes.

For a full and more complete understanding of the invention reference may be had to the following description and accompanying drawings wherein:

FIG. 8 is another detailed perspective of the control and operating member for swinging the scoop.

DESCRIPTION OF A PREFERRED EMBODIMENT

Figure 1:
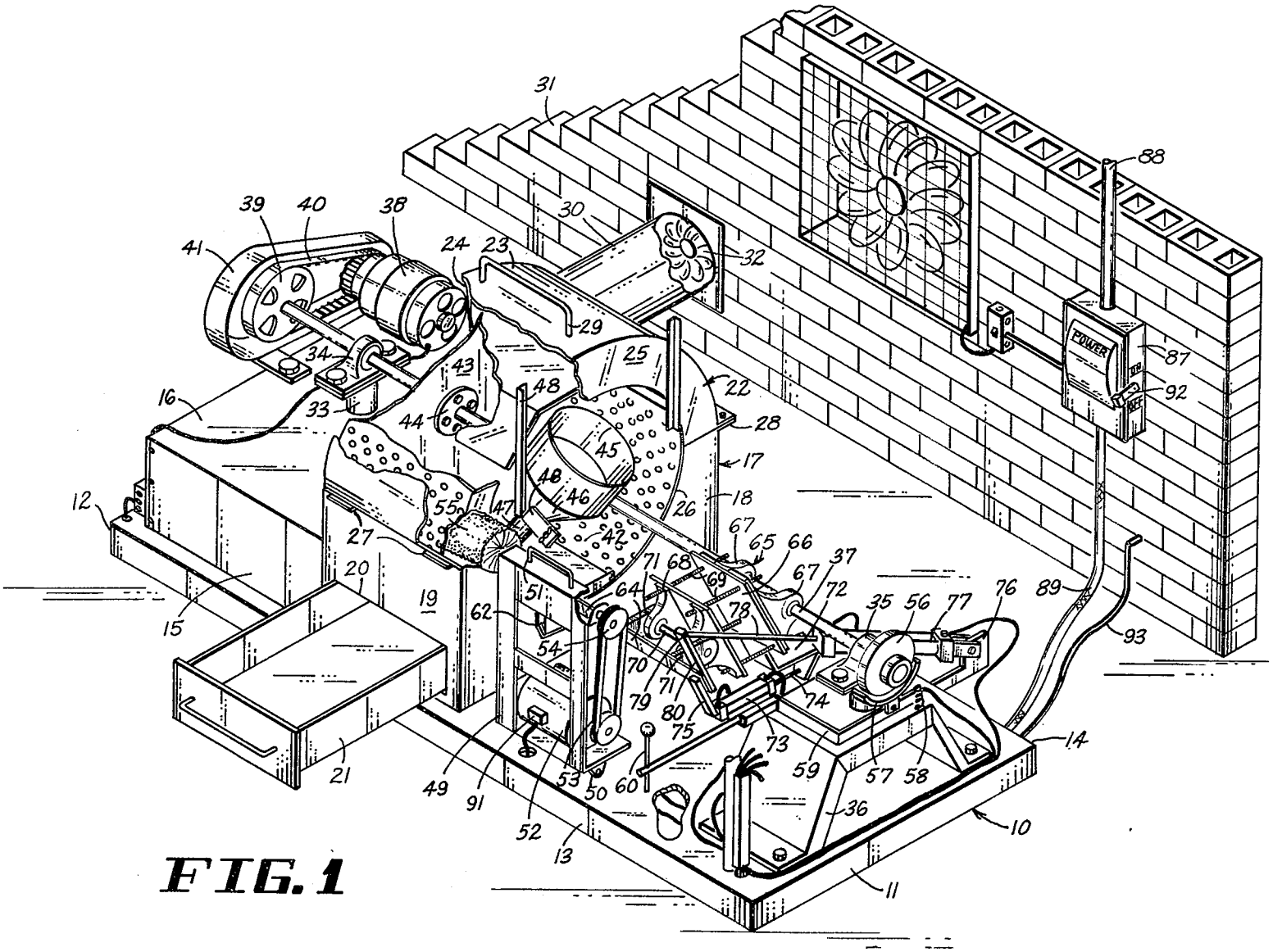
FIG. 1 is a perspective of a turquoise scrubber embodying the precepts of this invention, with parts broken away and some omitted to facilitate illustration.
Figure 2:
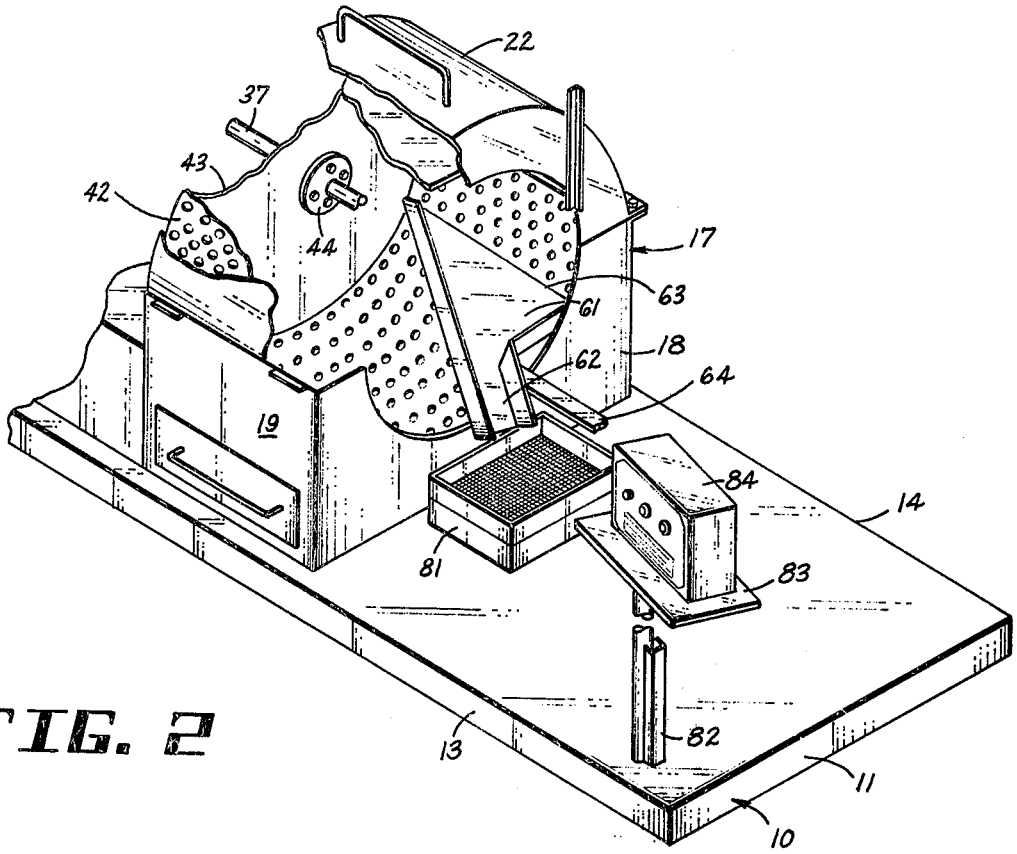
FIG. 2 is another perspective of the base, the casing, the screen, the discharge scoop, rock receiving receptacle, and control console.

Referring now to the drawings wherein like characters denote corresponding parts throughout the several views, and first more particularly to FIGS. 1 and 2, a base is identified in its entirety at 10. It is rectangular in shape presenting a front end 11, a rear end 12, and sides 13 and 14. Upstanding from base 10, adjacent to rear end 12, is a housing comprising two side walls 15, a top wall 16, and a rear wall (not designated). The forward end of this housing is open, or it may be provided with a wall having openings therein which communicate with a casing now to be described.

A casing designated generally 17 is of two parts. A lower casing part comprises a front wall 18, two side walls 19, and a rear wall which extends from top wall 16 to the upper edge of lower casing part 18, thus lower casing part communicates with the housing including side walls 15 and top wall 16. One side wall 19 of lower casing part is formed with a rectangular shaped opening 20 which accomodates a sliding drawer 21 having a purpose to be later described.

An upper casing part is designated generally 22. It comprises a semi-cylindrical wall 23, a rear end wall 24, which is semi-circular, having a lower edge which meets the upper edge of the rear wall of lower casing part 17. Extending inwardly from the front edge of this semi-cylindrical wall 23 is an arcuate wall 25. It, together with the edge 26 of a recess formed at the front wall 18 of the lower casing part, define a large circular opening or recess. Thus it is apparent that for practical purposes the casing 17 has an open front face and a closed rear end. The two casing parts are hingedly connected as indicated at 27 at one side, and the opposite sides are formed with cooperating elements of detachable connections shown at 28. A handle 29 enables an operator to swing the upper part out of its closed position for inspection and cleaning purposes.

An exhaust conduit 30 communicates at one end with a side wall 15, with its other end passing through a premise wall 31. An exhaust fan is associated with conduit 30 on the exterior of the premise and is represented somewhat diagrammatically at 32.

Upstanding from base 10 and passing through an opening in the top wall 16 of the rear housing is a standard 33 which carries at its upper end a bearing assembly 34. A second bearing assembly 35 is carried by support 36 mounted on base 10 adjacent to front end 11. A shaft 37 is journalled in the bearings 34 and 35 and passes through casing 17 substantially centrally thereof. An electric motor 38 is mounted on top wall 16 of the rear housing and has a drive shaft which is operatively connected to a gear 39 on shaft 37 by a drive belt 40. The latter may be protected by a guard 41.

A cylindrical screen 42 is mounted on a plate 43 which is driveably connected to shaft 37 as indicated at 44. Cylindrical screen 42 is spaced from the inner surface of the semi-cylindrical wall 22, side walls 19 of the lower casing part, and base 10. This spacing accomodates the passage of gel which is removed from the turquoise rock by centrifugal force and thus allows the gel to fall downwardly into drawer 21 when the latter is in closed position.

A loading chute is positioned at the open face of casing 17. It comprises an upper cylindrical part 45, a conical portion 46, and a tube 47, the lower open end of which is positioned within screen 42, the cylindrical part 45 being conveniently located just in front of the casing for the reception of rocks to be scrubbed. This loading chute is mounted on an angle bar 48 which depends from the arcuate wall 25 of the upper casing part.

A tilting frame 49 is pivotally mounted at its lower end on base 10 as indicated at 50. It is provided with a handle 51 to facilitate tilting by an operator. Mounted in the lower portion of the frame 49 is an electric motor 52 the drive shaft of which is connected by a belt 53 with a brush shaft 54 journalled in the upper part of frame 49. Brush shaft 54 extends into the interior of screen 42 and that portion thereof within the screen carries a cylindrical brush 55.

A brake drum 56 is driveably mouunted on the front end of shaft 37 and cooperating therewith is a brake shoe 57 which is biased out of engagement with drum 56 by a spring 58. Brake shoe 57 is mounted on a bar 59 of what might be called a double L shape and has a handle 60 at its outer end which may be availed of by an operator when it is desired to slow down rotation of shaft 37.

Referring now more particularly to FIG. 2, a discharge scoop is shown as comprising a main body portion 61 and a spout 62. The main body portion 61 has a leading edge 63 having an extent substantially the same as the axial length of screen 42. This discharge scoop is mounted on a bar 64.

Referring now to FIG. 1, this bar 64 is shown as extending to a swinging frame designated generally 65. Frame 65 includes an inner plate 66 which carries a pair of bearings 67 which receive shaft 37. An outer plate 68 is mounted on inner plate 66 in spaced relation thereto by screws 69 which provide for adjusting the distance between plate 66 and plate 68. Carried by outer plate 68 are a pair of ears 69 formed with aligned openings which receive a pivot pin 70. Secured to opposite ends of this pivot pin 70 are a pair of tabs 71 which extend from bar 64. Thus, it is evident that bar 64 may be pivoted on pin 70 to raise or lower the discharge scoop, that is, to move the leading edge 63 of the scoop into or out of engagement with screen 42.

Secured to the lower edge of plate 66 is a bracket 72 on which is mounted a pneumatic cylinder 73 having a piston 74 operatively associated therewith. At one end piston 74 carries a stub bar 75 which is connected to bar 64. Thus, it is evident that with air under pressure being admitted to cylinder 73, bar 64 may be swung to raise or lower the discharge scoop.

Figure 4:
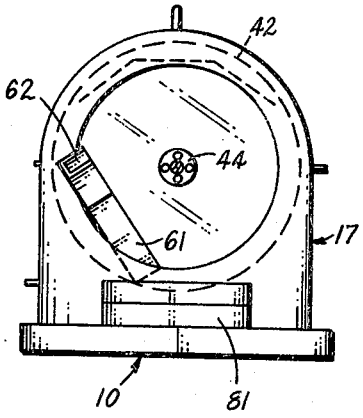
FIG. 4 is another end view, similar to FIG. 3, depicting the discharge scoop as lowered into a position in which its leading edge engages the screen.
Figure 5:
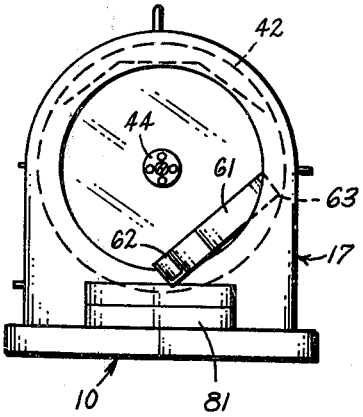
FIG. 5 is another end view similar to FIGS. 3 and 4, showing the discharge scoop at its other end of arcuate movement which is raised at the end of a scoop stroke.
Figures 4, 6, 7:
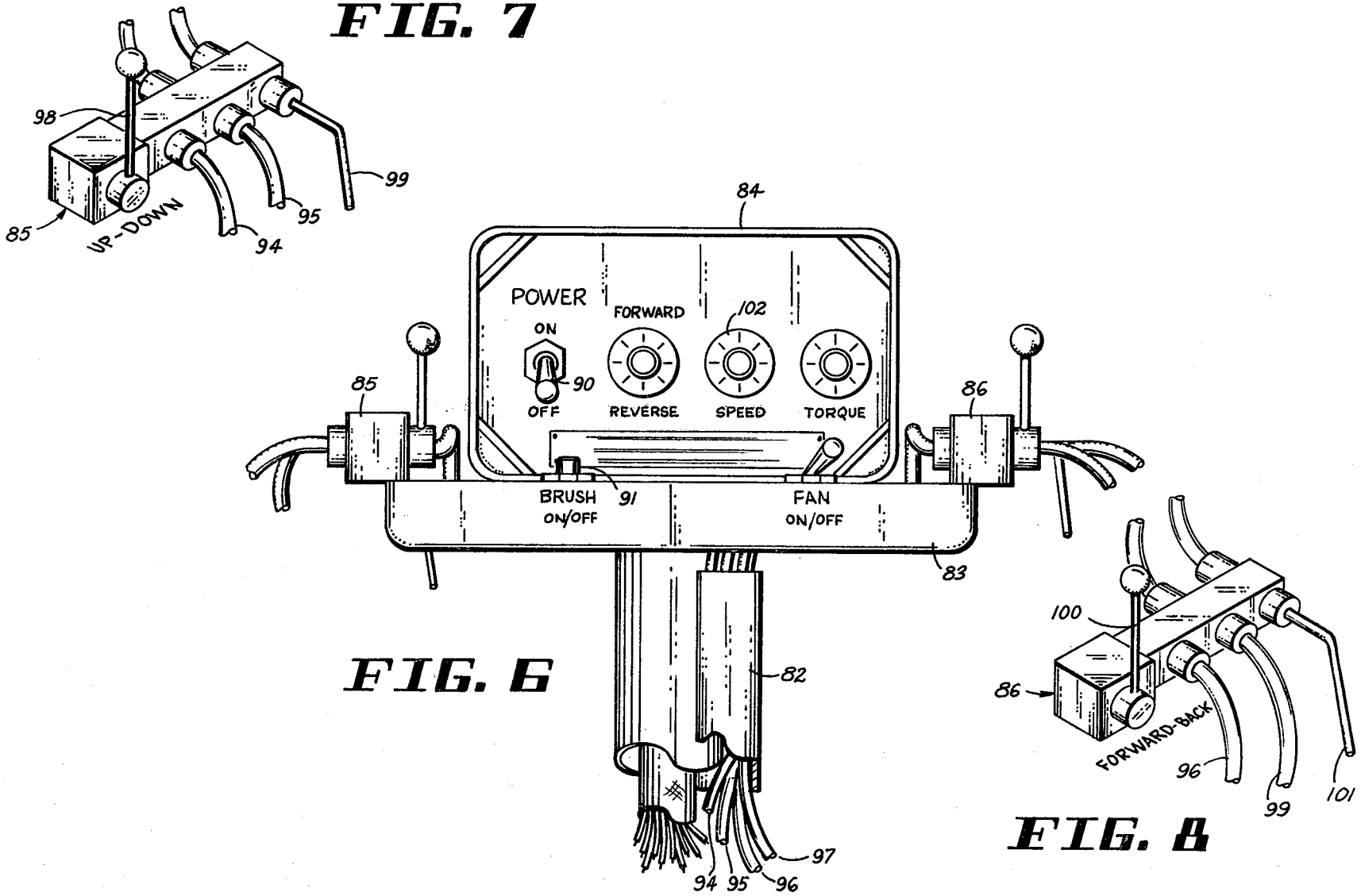
FIG. 6 is a front elevation of the control console.
FIG. 7 is a detailed perspective of the control and operating member for raising and lowering the scoop.

Extending outwardly from side 14 of base 10 is a bracket 76 on which a second pneumatic cylinder 77 is pivotally mounted. Cooperating with cylinder 77 is a piston 78 the outer end of which is pivotally connected as indicated at 79 to an arm 80 which extends from bar 64. With air under pressure being applied to the proper end of cylinder 77, frame 65 is swung as an entirety about shaft 37 as a pivot to move the discharge scoop from one limit of its movement as shown in FIG. 4 to its opposite limit as depicted in FIG. 5 or vice versa when the scoop is up-raised from the screen.

Referring now more particularly to FIG. 2, a receptacle 81 is shown as positioned on base 10 immediately in advance of the front wall 18 of the lower casing part in which position it receives scrubbed rock from spout 62. This receptacle is removable and replaced by another one when filled. Upstanding from base 10 adjacent to the corner defined by front 11 and side 13 is a hollow pedestal 82 which carries a platform 83 on its upper end. Mounted on this platform 83 is a control console 84 and two control valves represented schematically at 85 and 86.

As shown in FIG. 1, a power box 87 is mounted on wall 31 and is connected by cable 88 to a suitable source of electric power. From box 87 cables shown at 89 extend to motors 35 and 52. The extension to motor 35 is through a power switch 90 on console 84 while motor 52 is provided with "on-off" switches 91. With the main control switch 92 on power box 87 in "on" position, switch 90 may be operated to start motor 35 into operation or stop such operation. Likewise, either switch 91 can be used to start or stop motor 52. An air line 93 extends from a compressor, or other suitable source of air under pressure, and up through one section of the hollow standard 82. Air line 93 communicates with four branch lines 94, 95, 96, and 97. Lines 94 and 95 extend to the opposite ends of cylinder 73 through control valves 85. The latter includes an operating member 98 which is adapted to assume any one of three positions. The first of these is a neutral position in which air is admitted to neither end of cylinder 73. It may be swung from the neutral position to admit air to either end of the cylinder. When air is admitted to one end of the cylinder, it is exhausted from the other end through an exhaust tube 99.

Branch lines 96 and 97 extend to opposite ends of cylinder 77 through control valve 86. Like control valve 85, control valve 86 includes an operating member 100 and an exhaust tube 101. Control lever 100 is also adapted to assume three positions, one of these is in neutral or intermediate position and the other positions admit air to one end of cylinder 77.

OPERATION

While the manner in which the subject turquoise scrubber operates is believed to be obvious from the illustration of the drawings and description of parts set forth above, it is set forth as follows:

Screen 42 is designed to rotate over a range of 40 to 800 rpm. With the screen rotating at a low rate and the discharge scoop up-raised therefrom and at the limit of arcuate movement depicted in FIG. 3, a batch of turquoise rocks is loaded into the outer portion 45 of the loading chute and deposited on the inner surface of screen 42 by way of tube 47. The rotation of the screen 42 is now sped up by availing of the control therefor shown at 102 on console 84. The operator then tilts frame 49 to move brush 55 into engagement with the rocks, motor 52 having been energized. The bristles of the brush together with centrifugal force removes the gel from the rock surfaces and throws the gel through the perforations in screen 42. Any gel which may have collected on the brush bristles is also removed therefrom by centrifugal force generated by rotation of the brush. Drawer 21 will be in closed position and this gel falls thereinto through the space between the screen and the casing.

Figure 3:
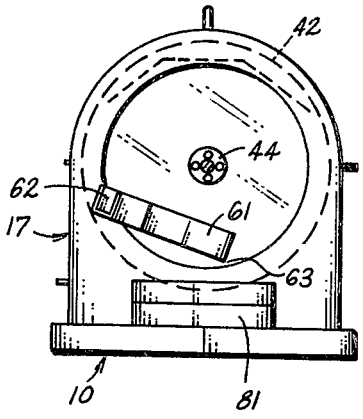
FIG. 3 is an end view that is highly schematic, illustrating the so called raised position of the discharge scoop at one limit of its arcuate movement.

After a prescribed batch time, which ordinarily is in the order of 2 minutes, operating lever 98 is availed of to introduce air into the proper end of cylinder 73 to lower the discharge scoop into the position depicted in FIG. 4 in which the leading edge 63 thereof engages screen 42. Before the scoop is lowered, brake handle 60 is engaged by the operator to apply the brake and slow down to substantially stop the rotation of the screen. The operator then swings lever 100 of control valve 86 to admit air into the proper end of cylinder 77 to swing frame 65 as an entirety and thus cause the discharge scoop to move from the position of FIG. 4 to that of FIG. 5. During this movement the leading edge of the scoop scrapes over the inner surface of screen 42 to pick up the cleansed rocks which then pass under gravity action through spout 62 into receptacle 81. The discharge scoop is then raised by control valve 85 and swung back into the position of FIG. 4 by control valve 86. A complete cycle of operation of the scoop may be said to begin with either the position of FIG. 3 or that of FIG. 5. The cycle beginning with FIG. 3 is described above. If the cycle is said to begin with the position of FIG. 5, the scoop is first raised, moved in a clockwise direction, speaking with reference to the drawings, back to the position of FIG. 3, lowered into the position of FIG. 4 and then swung in a clockwise direction into the position of FIG. 5.

While a preferred specific embodiment of the invention is herein disclosed it is to be clearly understood that the invention is not to be limited to the exact constructions, mechanisms, and devices illustrated and described because various modifications may be provided in putting the invention into practice.

What is claimed is:

1. In a turquoise scrubber for removing gel from the surfaces of turquoise rocks:

a. a base, b. a casing upstanding from said base and having a closed end and an open face, c. a pair of shaft supports upstanding from said base at opposite ends of said casing, d. a shaft rotatably mounted on said supports and passing through said casing substantially centrally thereof, e. a cylindrical screen driveably mounted on said shaft, disposed within said casing and spaced from the corresponding walls of said casing, f. power means for rotating said shaft, g. a loading chute mounted on said casing at the open face thereof, h. a brush pivotally mounted on said base and extending through said open face of the casing into said screen, i. power means for rotating said brush, j. a frame pivotally mounted on said shaft in a position spaced from said open face, k. mechanism for swinging said frame through a limited arcuate movement in reverse directions, l. a discharge scoop carried by said frame, located within said screen, moveable in said screen in said arcuate movement, and having a leading edge adapted to engage said screen and a spout projected through said open face, m. mechanism on said frame for raising and lowering said discharge scoop relative to said screen to bring the leading edge thereof into and out of engagement with said screen, and n. an exhaust conduit communicating with said closed end of said casing.

2. The turquoise scrubber of claim 1 in which the casing comprises lower and upper parts hingedly connected together with a drawer slideably received in said lower casing part.

3. The turquoise scrubber of claim 1 in which the cylindrical screen is carried by a circular wall adjacent to the closed end of the casing with the circular wall being driveably connected to the shaft.

4. The turquoise scrubber of claim 1 in which the power means for rotating the shaft is an electric motor.

5. The turquoise scrubber of claim 1 in which the brush is mounted on a frame which is pivoted to the base and the power means of rotating the brush comprises an electric motor on the brush frame.

6. The turquoise scrubber of claim 1 in which the frame comprises spaced plates with means for adjusting the distance between said plates.

7. The turquoise scrubber of claim 6 in which the mechanism for swinging the frame through a limited arcuate movement takes the form of a pneumatic cylinder pivoted at one end of the said base and having a piston pivotally connected to said frame.

8. The turquoise scrubber of claim 7 in which the mechanism on the frame for raising and lowering the discharge scoop comprises a second pneumatic cylinder carried by one of said plates, a pivot pin on the other of said plates, a bar connecting said scoop to said frame, tabs on said bar pivotally mounted on said pivot pin, and a piston in said second pneumatic cylinder having one end connected to said bar.

9. The turquoise scrubber of claim 1 in which the loading chute comprises an open end portion positioned exteriorally of the open face of the casing with a tube connected to said open end portion extending into the interior of the screen.

10. The turquoise scrubber of claim 1 together with a manually operable brake associated with said shaft.

* * * * *